US005272996A

United States Patent [19]

Drexler

[11] Patent Number: 5,272,996

[45] Date of Patent: Dec. 28, 1993

[54] SURFBOARD SAIL

[76] Inventor: Franz Drexler, Pasingerstrabe 17, D-8033 Planegg, Fed. Rep. of Germany

[21] Appl. No.: 915,815

[22] PCT Filed: Jan. 28, 1991

[86] PCT No.: PCT/EP91/00158

§ 371 Date: Jul. 21, 1992

§ 102(e) Date: Jul. 21, 1992

[87] PCT Pub. No.: WO91/11361

PCT Pub. Date: Aug. 8, 1991

[30] Foreign Application Priority Data

Jan. 26, 1990 [DE] Fed. Rep. of Germany ..... 4002317

[51] Int. Cl.[5] ..... B63H 9/04

[52] U.S. Cl. ..... 114/103; 114/39.2; 114/104

[58] Field of Search ..... 114/39.1, 39.2, 102, 114/103, 104, 112, 105, 89, 97

[56] References Cited

U.S. PATENT DOCUMENTS 3,205,849 9/1965 Thorndike ..... 114/102
3,345,969 10/1967 Purvis ..... 114/102
4,047,493 9/1977 Menegus ..... 114/102
4,669,407 6/1987 Cobb ..... 114/39.2

FOREIGN PATENT DOCUMENTS 2823418 6/1979 Fed. Rep. of Germany .
8608527 9/1986 Fed. Rep. of Germany .

*Primary Examiner*—Edwin L. Swinehart
*Attorney, Agent, or Firm*—Bacon & Thomas

[57] ABSTRACT

A surfing sail includes a basic sail, whose luff is attached to a mast associated in the usual way with a boom to the aft end of which is attached the clew of the basic sail and an auxiliary sail which serves reefing purposes. The auxiliary sail is triangular, narrow and long and its headboard is attached pivotally to the basic sail adjacent its top and in the proximity of the leech. At its foot region and at a level corresponding to the boom, the auxiliary sail is fitted with a guide batten, which is curved and arranged such that during pivotal movement of the auxiliary sail it is displaced along a circular path. The radius of the circular path corresponds to the distance of the guide batten from the pivot on which the auxiliary sail is fixed to the basic sail. The guide batten is guided longitudinally. The auxiliary sail can be reefed or taken out during surfing in a simple and easy manner, such that a windsurfer can reef or take out the surfing sail during surfing without any attendant problems.

10 Claims, 4 Drawing Sheets

SURFBOARD SAIL

BACKGROUND OF THE INVENTION

The invention relates to a surfing sail comprising a basic sail whose luff is attached to a mast which is associated in the usual way with a boom to the aft of which is attached the clew of the basic sail and an auxiliary sail which serves reefing purposes. The invention also relates to a boom for a surfing sail of this kind.

The surfing sail according to the invention together with the usual mast and the boom constitutes a surfing sail rig, which is attachable to a surfboard in a manner known per se. To this end the foot of the mast is inserted in an opening which is formed in the surfboard. The opening is usually located in the aft tertiary portion of the surfboard. This kind of assembly is known as a windsurfer or a stand-up sailer.

In order to adjust to the varying wind conditions and wind forces, it is desirable that the sail surface can be varied during sailing in a simple and rapid manner.

There has already been proposed a number of different surfing rigs with reefable sails. These rigs are provided either with detachable sail portions or wound up sails.

As regards the known wound up surfing sails reference is made, for example, to EP-0 139 782 B1.

When a surfing sail is arranged in this manner, that is, for example, it is intended to be wound up around the mast, then it is not possible to use continuous sail battens which are indispensible if a satisfactory sail profile is to be obtained. In addition the wound up sail has frequently a very unsatisfactory profile. Moreover, the rolling up of a sail is time consuming and, normally, it cannot be carried out during surfing.

Furthermore, it is known to make sails from compound sail portions of different sizes, which can be attached to the basic sail. A surfing sail of this kind is described, for example, in DE 39 03 167 A1.

With this kind of surfing sail which consists of assembled sail portions, it is, as a rule, not possible to attach or detach an additional sail portion during sailing. Moreover, the additional sail portion, once detached, has to be carried on the person of the windsurfer. This is inconvenient and impairs the freedom of movement of the surfers.

Furthermore, there is known from DE 38 05 135 a surfing sail rig, which can be reefed during sailing. This known surfing sail rig is provided not only with a sail mast to which is attached a sail but also with a boom mast to which is attached the boom and a tubular cladding having at least one recess for the reefing portion of the sail. The sail is reefed or taken out in that the sail mast is displaced towards the cladding or vice versa.

This construction is not only extremely wasteful and thus expensive, but also unreliable in service and, on top of that, heavy.

A further surfing sail whose size can be varied is described in German Utility Model G 86 08 527.1. This known surfing sail is arranged as a duplex sail, and an auxiliary sail is disposed between the two sail portions and its disposition relative to the duplex sail can be varied. In the reefed condition the auxiliary sail is taken in wholly between the two sail portions and thus it is totally covered up. In the taken out position larger or smaller surfaces of the auxiliary sail project out of the duplex sail so that the total surface of the sail is increased to a greater or lesser extent.

This known surfing sail can be reefed or taken out with great difficulty only, during surfing, because in order to change the position of the auxiliary sail one has to operate several rope ends, for example, the halyard as well as the downhaul, and the sheet.

SUMMARY OF THE INVENTION

The object of the present invention is to provide an improved surfing sail which can be reefed and taken out during surfing in a short period of time and in an easy and simple manner.

The surfing sail according to the invention is provided with an auxiliary sail which is substantially triangular, narrow and long. The auxiliary sail is attached pivotally at its headboard to a pivot which is disposed adjacent the top of the basic sail and in the proximity of its leech, whereby the attachment is, in particular, longitudinally adjustable. Thus the auxiliary sail tapers more or less towards its headboard and the size of the angle depends on the length of the foot of the substantially triangular auxiliary sail.

The attachment must be of the kind which permits pivotal movement of the auxiliary sail, such that the leech of the latter in the reef condition thereof does not project beyond the leech of the basic sail. In other words, in the reef condition the auxiliary sail has to substantially overlap with the basic sail. The point of attachment of the auxiliary sail is reinforced appropriately by a continuous batten on the basic sail.

The lower portion of the auxiliary sail is provided at about the level of the boom and thus in the proximity of the foot with a guide batten. The guide batten which is arcuate extends substantially horizontally and its curvature is directed towards the headboard of the auxiliary sail. The radius of curvature corresponds substantially to the distance of the guide batten from the point of attachment at which the auxiliary sail is affixed to the basic sail. During pivotal movement of the auxiliary sail about the point of attachment the guide batten is thus displaced along a circular path.

Of course, it would be possible to arrange and/or curve the guide batten such that it moves along a circular path whose radius is slightly greater than the distance of the point of attachment from the aft guide member or guide batten, such that the distance of the aft end of the guide batten with respect to the point of attachment is increased during reefing. In this way the leech of the auxiliary sail can be put under tension.

The guide batten is provided with an aft section which extends over the whole width of the auxiliary sail and a forward section which extends from the luff of the auxiliary sail forwardly to the mast. The guide batten can be disposed laterally of the auxiliary sail, in the plane thereof or bilaterally of the plane of the auxiliary sail and be of integral construction or composed of a number of parts which are joined together.

The guide batten is displaced longitudinally by means of its forward section which engages a guide member attached to the basic sail. In the simplest case the guide member can take the form of a batten pocket which is sewn onto the basic sail and in which the forward section of the guide batten can be moved to and fro when the auxiliary sail is reefed or taken out. The length of the forward section must be sufficiently long such that a portion of the forward section is still located in the batten pocket when the auxiliary sail is taken out.

In the present case one deals with a guide member which has an adequate strength, for example, one made from a synthetic plastics material. The guide batten is attached to the basic sail and has such a shape or is provided with such means that the guide batten is displaced along a circular path or to and fro. The intersection of the guide member with the forward section of the guide batten has for its purpose the prevention of either the separation of the forward section of the guide batten from the basic sail or its up and down movement.

In addition the guide batten is longitudinally guided at its aft section in an aft guide member such that also in this case the guide batten carries out a movement along the desired circular path. To this end the aft guide member is attached either to the aft end of the boom or the basic sail proper.

In order to reef or take out the sail according to the invention it is only necessary to displace the guide rail along its circular path. This can take place during surfing without any attendant problems. Apart from the parts needed to attach the auxiliary sail, to the basic sail only few other parts are necessary, viz. a guide batten and two guide members in order to make the surfing sail according to the invention fit for reefing. This means that the surfing sail according to the invention is only slightly heavier than the usual sail whose size corresponds to the surfing sail according to the invention. This is also made possible due to the fact that in the taken out condition of the auxiliary sail, the latter overlaps the basic sail only to a small extent. Thus in the taken out condition practically the whole surface of the auxiliary sail is available for propulsion. Moreover, the surfing sail according to the invention displays an aerodynamic cross-section both in the reefed and taken out condition.

The guide batten should display the greatest possible resistance to bending. The guide batten can be made, for example, from aluminum or a plastics material having adequate strength.

According to a preferred embodiment the guide batten comprises a guide rail which has an open side facing the guide members and which is engaged by the latter. Alternatively, the guide rail is in engaging contact with the guide members.

In the latter embodiment the guide members are guided in the guide rail. the circumstances can, of course, be reversed such that the guide batten is guided longitudinally in the guide members. According to a still further preferred embodiment, the guide batten can take the form of a tubular section having preferably a rectangular cross-section. The forward guide member is then provided with a corresponding section in order to encompass or embrace the tubular section. In the case of a tubular section having a rectangular cross-section, the forward guide member takes the form of a C-section.

In accordance with a still further preferred embodiment the guide batten is constituted by two joined, preferably identical, tubular sections, which have appropriately a rectangular cross-section. These two tubular sections extend laterally of the auxiliary sail, such that the latter extends or is inserted between them. Moreover, this embodiment is also provided with a spacer element which is inserted between the tubular section along at least the forward section thereof. The spacer element can take the form of a spacer strip such that the tubular section which is adjacent the basic sail can be guided in the forward guide member or encompassed or embraced thereby. It is also necessary to avoid a direct contact between the forward sections of the tubular-members. Such a spacer element or spacer strip can be provided in the aft section and, in particular, between the auxiliary sail and the tubular section which is guided in the forward guide member. In that way there is provided a space between the auxiliary sail and the tubular section. It is understood that the two tubular sections as well as the spacing element are interconnected with one another, for example, by means of bolts or screws. In consequence thereof one obtains a guide batten which is extremely resistant to torsion and bending.

The forward guide member is preferably located on the basic sail in such a manner that it is disposed directly in front of the luff of the auxiliary sail when the surfing sail is reefed and the leeches of the auxiliary sail and the basic sail overlap each other. In that way the guide member is disposed at the edge of the region of the basic sail which is overlapped by the auxiliary sail in its reefed condition.

When the aft guide member is arranged on or attached to the basic sail, then it is preferred that it takes the same form as the forward guide member. The aft and forward sections of the guide batten are arranged or shaped identically. If the forward guide member is constituted by a C-shaped section then the aft guide member is likewise constituted by a C-shaped section. In this instance the guided tubular section must, of course, be spaced appropriately from the auxiliary sail with the aid of, for example, a spacer strip such that it can be embraced.

In accordance with a particularly preferred embodiment the guide batten is provided with an oblong slot, which extends substantially along the whole length of the aft section or substantially over the whole length of the guide batten, whereby the aft guide member moves in the aft section of the oblong slot and, in the case that the oblong slot extends also along the forward section, the forward guide member is also guided in the oblong slot and, viz. in the forward section thereof. The oblong slot which extends substantially over the whole length of the guide batten is appropriately interrupted in the luff region of the auxiliary sail by, for example, a vertical web or the like in order to form two sections which are separated from each other, i.e. one in the aft section and the other in the forward section. In this embodiment the guide members can take the form of horizontally disposed bolts which extend across the oblong slot and which are provided at their free ends with means, for example, widened portions, which prevent the bolts from being removed from the oblong slot. If the guide batten consists of a number of parts, for example, two tubular sections of rectangular cross-section and, as the case may be, a spacer element, then all the parts are provided with such an oblong slot so that the guide member can extend across all the parts. Also the auxiliary sail must be provided with a corresponding cut-out therein.

In accordance with a still further particularly preferred embodiment, the aft guide member is attached to the aft end of the boom and takes the form of a substantially horizontally extending bolt which interconnects the two aft ends of the transoms of the boom. This embodiment provides the advantage that the forces transmitted by the auxiliary sail to the aft guide member are taken up by the boom and not by the basic sail itself. Thus the position of the aft guide member is determined unequivocally and the latter can be adequately dimensioned without any difficulty in order to take up the occurring forces.

In accordance with a further preferred embodiment, the aft section of the basic sail takes a duplex form such that the two layers of the basic sail provide a pocket into which the auxiliary sail can be reefed completely. One of the layers or flaps is provided with a cut-out or slit for insertion of the forward section of the guide batten. In this way the wind is prevented from entering into the space between the auxiliary sail and the basic sail in its reefed condition and thereby tend to lift off the latter. In the taken out condition the luff region of the auxiliary sail overlaps still the leech region of the two flaps of the basic sail, whereby ingress of the wind between the luff of the auxiliary sail and the leech of the basic sail is prevented. The basic sail merges continuously with the auxiliary sail such that the wind flow is not at all disturbed or if any then to a very small extent only.

In addition, the auxiliary sail is provided with at least one continuous sail batten which projects beyond the luff and is provided at its forward section with a pair of spaced parallel between which is disposed the basic sail. The arrangement with two arms ensures that the sail batten is supported on the basic sail independently of the wind direction, i.e. whether it blows from the port or starboard.

The sail batten is in particular curved and arranged in such a manner that during reefing of the auxiliary sail it is displaced along a circular path whose radius corresponds to the distance of the sail batten from the point of attachment at which the auxiliary sail is affixed to the basic sail. In this way the sail batten like the guide batten is displaced along a circular path whose center corresponds to the point of attachment.

When such a sail batten is made use of, then the basic sail must be provided with a slit for insertion of an arm of the bifurcated forward section of the sail batten. If the aft region of the basic sail is provided with the duplex portion then one of the flaps must also be provided with a slit for insertion of the sail batten.

The subject-matter of the invention also includes a boom for the surfing sail according to the invention and includes two transoms which are interconnected at their forward and aft ends, the boom being characterized that the aft connection of the two transoms consists of a bolt which extends substantially horizontally.

In the following the preferred embodiments of the invention will be described with reference to the schematic figures which are not drawn to scale.

DETAILED DESCRIPTION OF THE INVENTION

Figure 1:
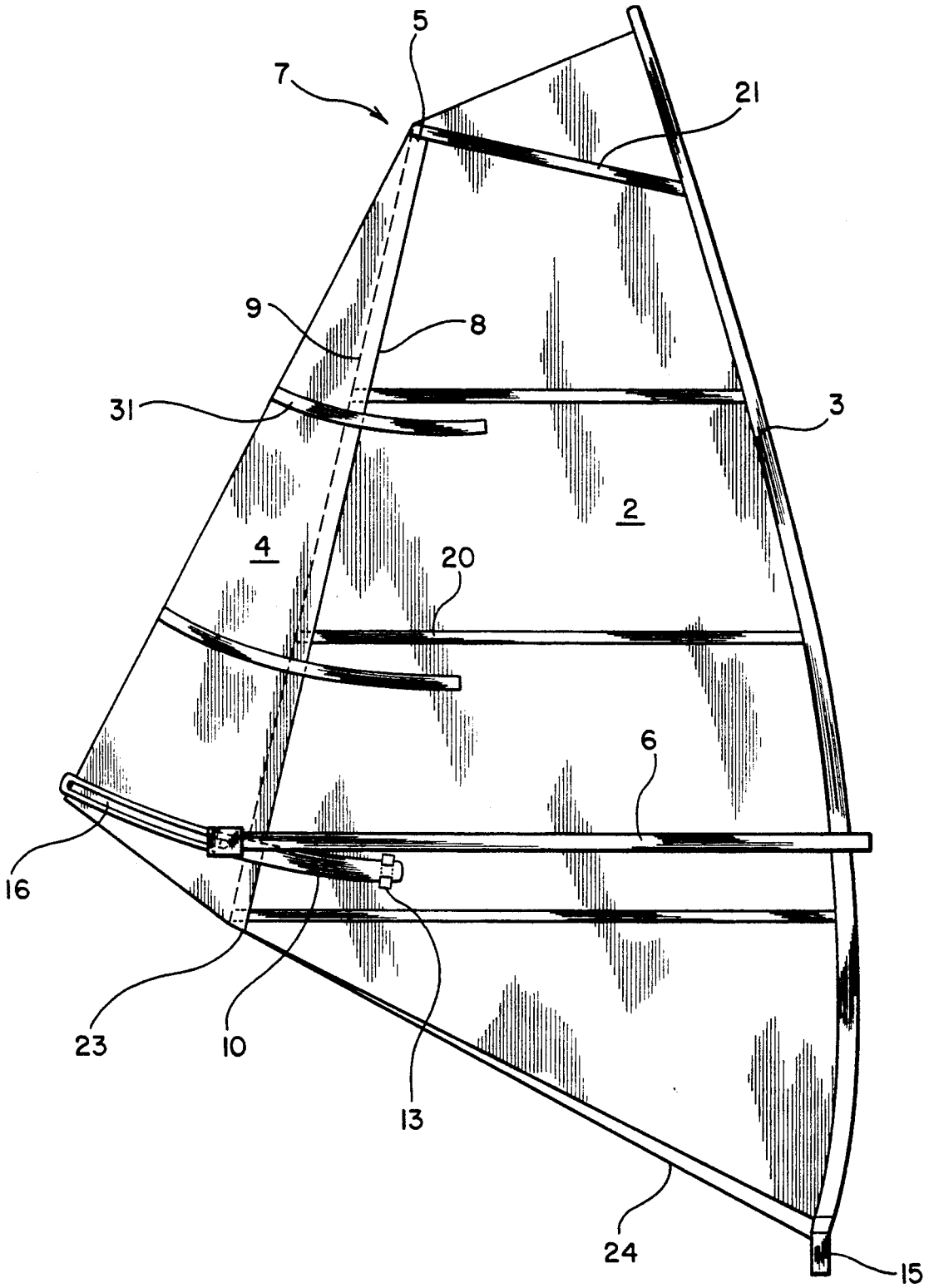
FIG. 1 shows a plan view of a surfing sail according to the invention in its taken out condition.

The surfing sail according to the invention and shown in the end elevation in FIG. 1 comprises a basic sail 2, which is attached in a known manner to a mast 3. In addition the basic sail is provided with a sail pocket (not shown in detail) into which is inserted the mast 3 from the bottom thereof. The basic sail 2 has a configuration known per se. The foot 15 of the mast 3 can be inserted in an opening (not shown) of the surfingboard (likewise not shown). The forward end of a boom 6 is attached to the mast 3 in a manner known per se.

The basic sail 2 is provided with three horizontal continuous sail battens 20 and comprises additionally a fourth continuous sail batten 21 which extends adjacent the top of the basic sail 2 from the mast 3 to the headboard 7 of the auxiliary sail 4 and supports the point of attachment or pivot 5 at or on which the auxiliary sail 4 is attached pivotally on the basic sail 2.

The pivotal attachment of the auxiliary sail 4 can be effected with the aid of a textile belt which is associated therewith and which is supported by a belt buckle attached to the basic sail 2. In this way there is provided a longitudinal adjustment which permits of varying the initial tension in the vertical direction in the auxiliary sail 4. It is, of course, also possible to attach the auxiliary sail 4 pivotally to the basic sail 2 about a fixed point of attachment 5.

The auxiliary sail 4 has substantially the triangular shape of a sloop sail and is cut to provide an elongate and narrow configuration.

For taking out, the auxiliary sail 4 is swung out to such an extent that the leech 9 of the basic sail 2 and the luff 8 of the auxiliary sail 4 are parallel to each other, whereby both sails overlap each other in this region to a small extent. In the embodiment shown in the figures the auxiliary sail 4 is disposed in front of the basic sail 2, as seen by the viewer.

The auxiliary sail 4 is provided in its foot region with a guide batten 10 which during swinging out of the auxiliary sail 4 is displaced about the pivot 5 along a circular path whose radius corresponds approximately to the distance of the guide batten from the pivot 5.

The guide batten 10 is guided during its longitudinal displacement both by forward guide member 13 and an aft guide member, viz. a bolt 14.

Figure 3:
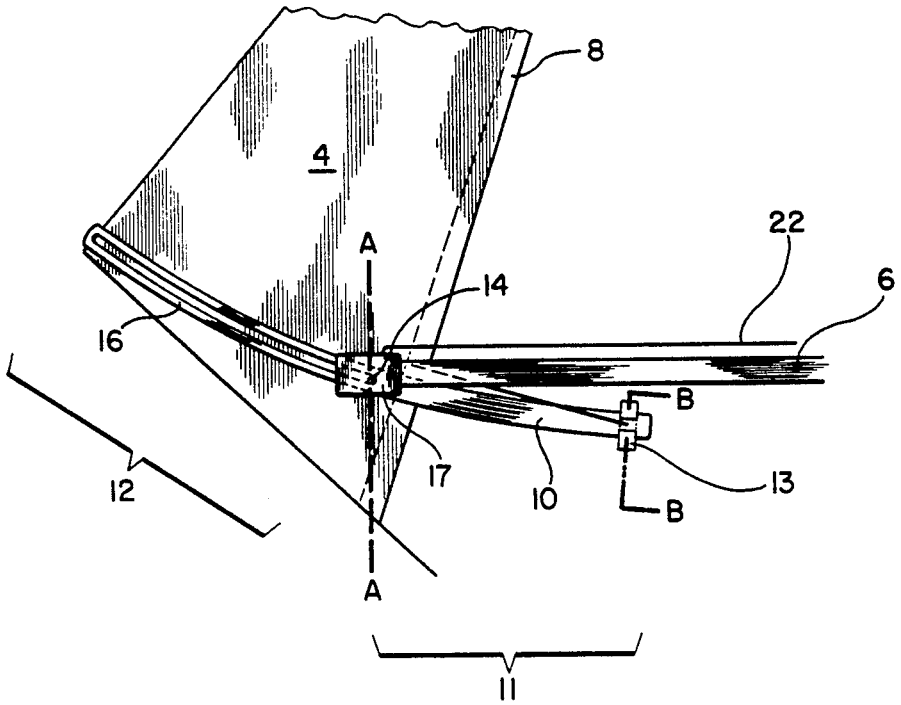
FIG. 3 shows a plan view on an enlarged scale of the foot section of the auxiliary sail according to FIG. 1.

As can be seen in particular in FIG. 3, the guide batten 10 is provided in its aft section 12 with an oblong slot 16 through which extends the bolt 14.

The boom 6 is provided at both ends of its transoms with fittings 17 which retain the bolts 14 by means of which both ends of transoms of the yoke are joined permanently to each other.

During pivotal displacement of the auxiliary sail 4, the bolt 14 slides along the oblong slot 16.

The forward guide member 13 acts in the manner of a clasp which engages and embraces the forward section 11 of the guide batten 10. The forward guide member 13 is attached to the basic sail 2.

Fittings 17 are spaced from each other by a distance which is slightly greater than the thickness of the guide batten such that the guide batten is guided substantially centrally in the median plane of the boom.

Figure 2:
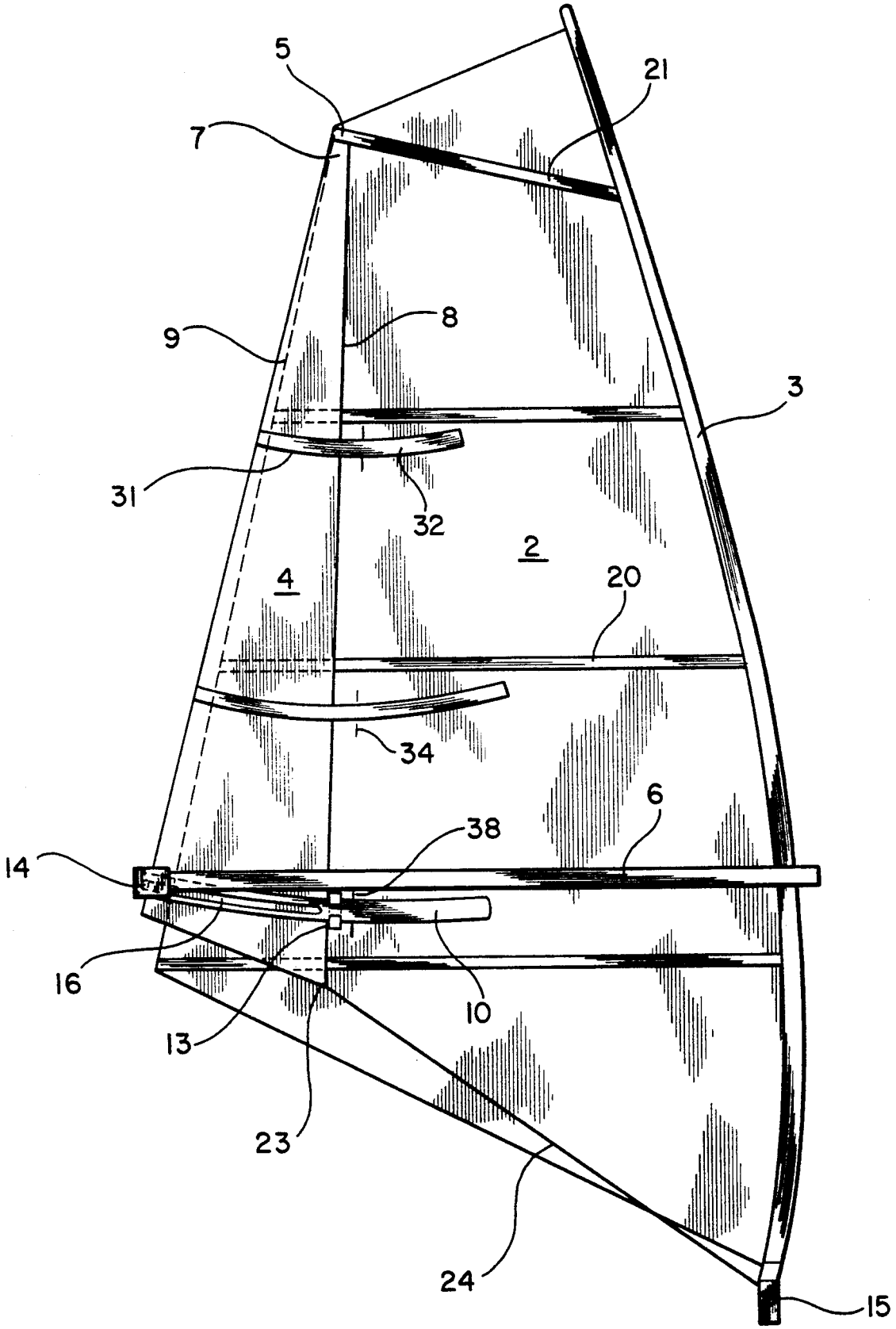
FIG. 2 shows a plan view of the same surfing sail but in its reefed condition.

During surfing the wind exerts a force on the auxiliary sail 4 which displaces the auxiliary sail leewards. If in the embodiment shown in FIG. 3 the wind arrives from the side of the viewer then the auxiliary sail 4 is displaced away from the viewer. Since the guide member 14 together with the fittings 17 forms a kind of a bearing for the guide batten 10, the forward section of the guide batten 10 will be displaced towards the viewer. Since, however, the wind exerts a force also on the basic sail 2 and displaces the latter away from the viewer, this force will be transferred via the guide member 13 to the guide batten 10 with the result that the forces acting on the auxiliary sail 4 and the basic sail 2 will be substantially equalized. In consequence of this the auxiliary sail 4 is disposed in the projection of the basic sail 2 such that the shape of the surfing sail corresponds substantially to aerodynamic requirements. The length of the forward section 11 of the guide batten 10 should correspond to at least the length of the aft section 12. In practice the length of the forward section 11 is slightly greater, in consequence of which, the forward guide member 13 in the reefed condition of the surfing sail is disposed in front of the luff 9 of the auxiliary sail 4. This situation is illustrated in FIG. 2, which shows the surfing sail according to the invention in its reefed condition.

However, it is also possible to attach the forward guide member 13 farther aft in the region of the basic sail 2 which is overlapped by the auxiliary sail 4 in its reefed condition. It is then possible to shorten the forward section 11 of the guide batten 10. In this case care should be taken that the auxiliary sail 4 can be guided past the guide member 13.

Insofar as nothing is said to the contrary the same reference signs will be used throughout for identical parts shown in the figures.

An end of a rope 22 is attached to the forward end of the guide batten 10 and the rope is then passed to the leech end of the boom 6, reversed and led back to the forward end (see FIG. 3), so that during surfing the windsurfer can pull on the rope to swing the guide batten 10 in the aft direction. A rubber loop 24 which is attached to the neck of the auxiliary sail 4 (see FIG. 4), is passed to the foot 15 of the mast. On releasing the rope 22 the rubber loop 24 pulls the auxiliary sail 4 automatically back into its reefed condition, which is shown in FIG. 2.

Figure 4:
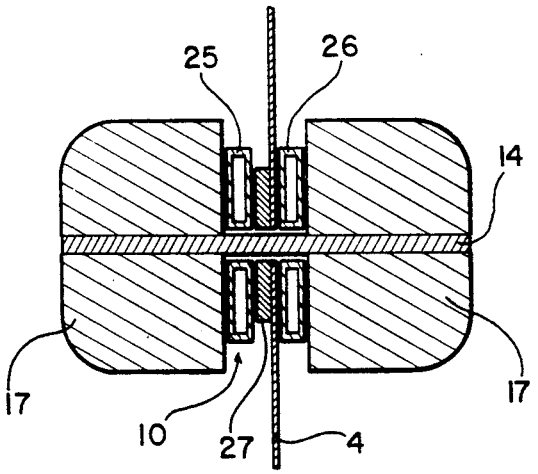
FIG. 4 shows a section along line A—A in FIG. 3.

As can be seen in particular in FIG. 4, the guide batten 10 comprises two tubular sections 25, 26 of rectangular cross-section, whereby the tubular section 25 is disposed on the one side and the tubular section 26 on the other side of the auxiliary sail 4.

A spacing strip 27 is disposed between the tubular section 25 and the auxiliary sail 4 such that the tubular section 25 is spaced from the auxiliary sail 4 by a desired distance. The width of the spacing strip 27 is smaller than the width of the rectangular tubular section 25 so that the forward section of the guide batten 10 or the rectangular tubular section 25 can embrace or encompass the C-shaped tubular guide member 13. The C-shaped tubular section is arranged such that the tubular section 25 can be displaced in the forward guide member 13 in the forward or aft direction. The tubular sections 25, 26 as well as the spacing strip 27 are, of course, rigidly interconnected with one another, for example, by a bolt, and the auxiliary sail 4 is inserted between the tubular sections in the aft end thereof.

Figure 5:
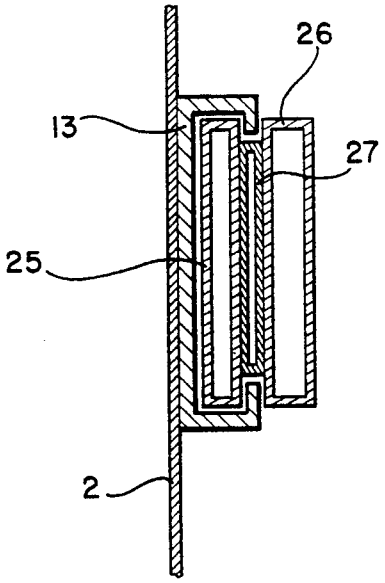
FIG. 5 shows a section according to line B—B in FIG. 3.
Figure 6:
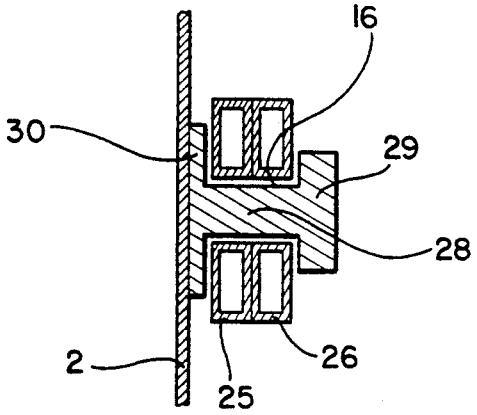
FIG. 6 shows a section through the forward guide member as well as a guide batten which is provided with an oblong slot in the forward section.
Figure 7:
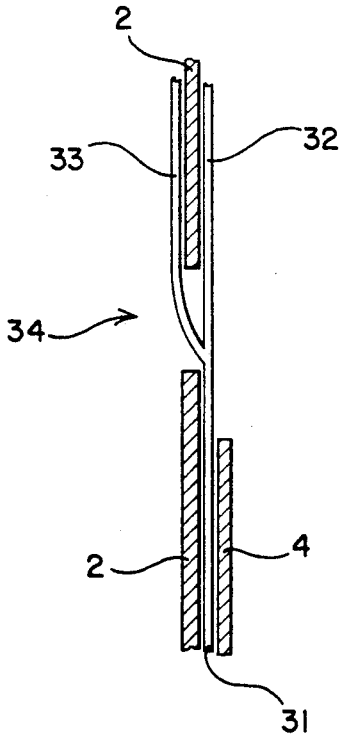
FIG. 7 shows a plan view of a sail batten.

FIG. 6 shows a section which is similar to that in FIG. 5, but taken through a forward guide member and guide batten of a different embodiment. The forward guide member 13 is provided with a spigot which extends through the oblong slot 16 in the forward section of the guide batten 10. The free end of the spigot 28 is provided with a cheese-head 29 for guiding the guide batten 10 between the cheese-head 29 and foot 30 of the forward guide member 13. The cheese-head 29 prevents also the extraction of the spigot 28 out of the oblong slot 16. The guide batten consists of two rectangular tubular sections 25, 26 which are rigidly interconnected with each other.

The auxiliary sail 4 is provided with two continuous sail battens 31 which project past the luff 8 of the auxiliary sail 4, whereby the battens are provided at their forward ends with bifurcated arms 32, 33 between which is disposed the basic sail 2. The basic sail 2 is provided at a certain distance from the luff 8 of the auxiliary sail 4 in its reefed condition with a slit 34 for passing the arm 33 therethrough.

Figure 8:
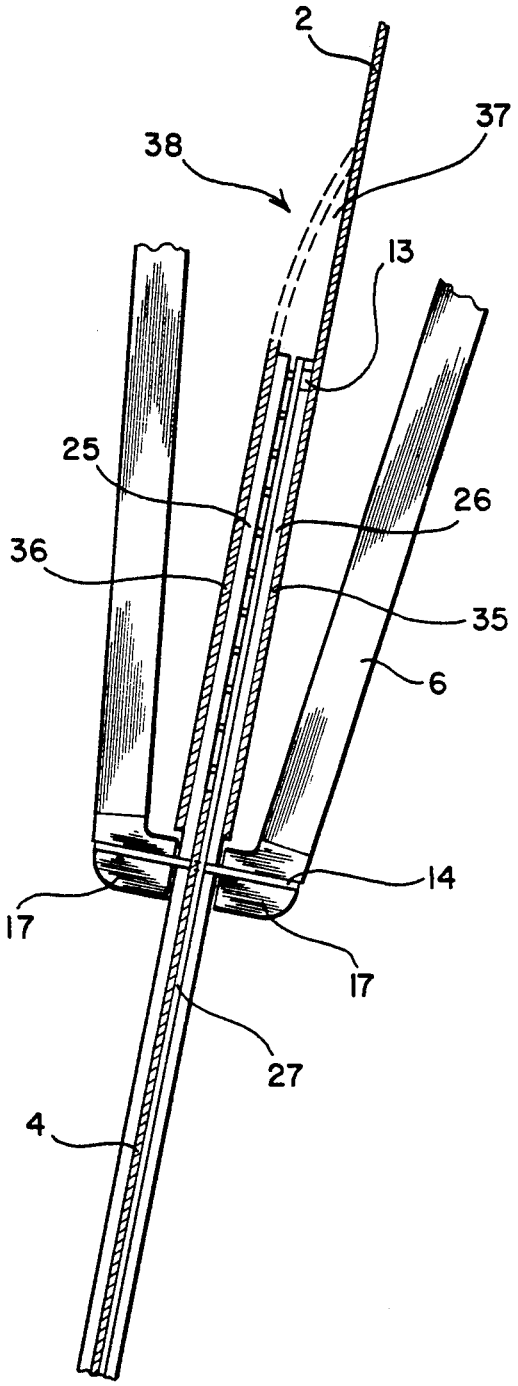
FIG. 8 shows a plan view, partially in section, of the aft end section of a boom.

As can be seen in particular in FIG. 8, the basic sail 2 is provided in its aft region with a duplex section. For reasons of simplicity the duplex section is not shown in the remaining figures. Both flaps 35, 36 of the duplex section form a pocket 37 into which the auxiliary sail 4 can be completely or almost completely reefed in. Even in the taken out condition the auxiliary sail 4 overlaps the pocket 37 so that the wind cannot act behind the luff 8 of the auxiliary sail 4.

Adjacent its front edge and at a level which coincides with the guide batten 10 the flap 36 is provided with a slit 38 through which is passed the guide batten during reefing. The flap 36 is provided with similar slits at the level of sail battens 31.

The boom which is shown in FIG. 8, is provided at its aft end with a bolt 14 which interconnects rigidly both ends of the boom or the fittings which are disposed thereon.

In the region of the oblong slot 16 the auxiliary sail 4 is provided with an appropriate cut-out.

I claim:

1. A surfing sail comprising:

a mast;

a boom having fore and aft end portions, said fore end portion being attached to said mast;

a basic sail including a luff and a leech, said luff being attached to said mast;

an auxiliary sail having an associated headboard and luff, said auxiliary sail being long, narrow and substantially triangular, said headboard having an upper section pivotally connected adjacent a top portion of said basic sail in the proximity of said leech and a lower section;

a guide batten carried by the lower section of said auxiliary sail, said guide batten being curved so as to move along a circular path, the radius of which corresponds to the distance between the guide batten and the pivot location of the upper section of said headboard, during pivoting of said auxiliary sail, said guide batten having an aft section which extends across the entire width of said auxiliary sail and a forward section that extends from the luff of said auxiliary sail forwardly;

a forward guide member attached to said basic sail, said forward guide member being interconnected with the forward section of said guide batten for longitudinally guiding said guide batten; and an aft guide member attached to one of the aft end portion of said boom and said basic sail, said aft guide member being interconnected with the aft section of said guide batten for longitudinally guiding said guide batten.

2. A surfing sail according to claim 1, wherein the guide batten is constituted by a guide rail having an open side which faces said forward and aft guide members and which is engaged thereby.

3. A surfing sail according to claim 1, wherein the guide batten is constituted by a tubular section and the forward guide member has a corresponding cross-section for encompassing and bilaterally embracing the tubular section.

4. A surfing sail according to claim 1, wherein the guide batten comprises two interconnected, tubular sections, the auxiliary sail being positioned between said tubular sections and, a spacing strip is also inserted therebetween in at least the forward section of said guide batten, whereby only the tubular section which adjoins the basic sail is guided in the forward guide member.

5. A surfing sail according to claim 1, wherein the forward guide member is located on the basic sail directly in front of the luff of the auxiliary sail, with the surfing sail in a reefed condition and when the leeches of the basic sail and the auxiliary sail substantially overlap each other.

6. A surfing sail according to claim 1, wherein the aft guide member is disposed adjacent the leech of the basic sail and its arrangement corresponds to that of the forward guide member.

7. A surfing sail according to claim 3, wherein the guide batten is provided with an oblong slot which extends substantially over the whole length of the aft section of the guide batten for interconnecting said guide batten and at least said aft guide member.

8. A surfing sail according to claim 7, wherein the aft guide member is constituted by a horizontally extending bolt which is located on the aft end portion of the boom, said bolt extending through said oblong slot.

9. A surfing sail according to claim 1, wherein the basic sail has a duplex section in its leech to provide a pocket which is formed by two flaps of the duplex section and into which the auxiliary sail is received, whereby one of the flaps is provided with a slit for passing the forward section of the guide batten therethrough.

10. A surfing sail according to claim 1, wherein the auxiliary sail is provided with at least one continuous sail batten which projects past the luff of the auxiliary sail and its forward section comprises two parallel arms between which is located the basic sail, whereby the sail batten is arranged and curved in such a manner that during pivoting of the auxiliary sail, said sail batten is displaced along a circular path whose radius corresponds to the distance of the sail batten from the pivot by means of which the auxiliary sail is attached to the basic sail.

* * * * *